United States Patent [19]

Uhlig

[11] Patent Number: 4,471,870

[45] Date of Patent: Sep. 18, 1984

[54] PACKAGE FOR HOLDING A PLURALITY OF DISCRETE CONTAINER ASSEMBLIES

[75] Inventor: Albert R. Uhlig, Toledo, Ohio

[73] Assignee: Owens-Illinois, Inc., Toledo, Ohio

[21] Appl. No.: 398,058

[22] Filed: Jul. 14, 1982

[51] Int. Cl.[3] ..... B65D 65/28; B65D 25/20; B65D 5/46

[52] U.S. Cl. ..... 206/150; 206/427; 206/434; 206/602; 229/52 B

[58] Field of Search ..... 206/427, 429, 430, 434, 206/200, 142, 145, 147, 146, 151, 150, 497, 503, 206/161, 602, 192, 428, 432; 229/52 BC, 52 B, 16 R, 229/52 AL, 30, 89; 217/19

[56] References Cited

U.S. PATENT DOCUMENTS

| | | | |
|---|---|---|---|
| 1,856,729 | 5/1932 | Robinson | 229/52 B |
| 1,909,898 | 5/1933 | Roland et al. | 229/52 B |
| 2,202,153 | 5/1940 | Jones | 229/52 BC |
| 2,293,342 | 8/1942 | Inman | 229/16 R |
| 2,313,731 | 3/1943 | Brogden | 229/16 R |
| 2,785,846 | 3/1957 | Weiner | 229/52 B |
| 2,802,614 | 8/1957 | Gelin | 206/503 |
| 2,828,009 | 3/1958 | Andre | 206/427 |
| 2,850,159 | 9/1958 | McGihon | 206/427 |
| 2,911,126 | 11/1959 | Holton | 229/52 BC |
| 2,959,342 | 11/1960 | Silverstein | 229/52 AL |
| 2,980,240 | 4/1961 | Amatel | 206/45.14 |
| 3,002,613 | 10/1961 | Merkel et al. | 206/430 |
| 3,114,496 | 12/1963 | Wilcox | 229/52 AL |
| 3,245,527 | 4/1966 | Martin | 206/427 |
| 3,302,783 | 2/1967 | Lyon | 206/150 |
| 3,338,404 | 8/1967 | Becker et al. | 206/427 X |
| 3,346,167 | 10/1967 | Schmidt | 206/427 X |
| 3,353,326 | 11/1967 | Beeker | 206/497 |
| 3,404,773 | 10/1968 | Kirby, Jr. | 206/158 |
| 3,415,366 | 12/1968 | Lillis | 206/427 |
| 3,540,582 | 11/1970 | Wood et al. | 206/192 |
| 3,650,395 | 3/1972 | Hobbs | 206/497 X |
| 3,677,458 | 7/1972 | Gosling | 206/427 X |
| 3,756,397 | 9/1973 | Ganz | 206/161 X |
| 3,895,713 | 7/1975 | Bunnell | 206/427 |
| 3,912,157 | 10/1975 | Graser | 206/146 X |
| 3,933,303 | 1/1976 | Kirby, Jr. | 229/52 B |
| 3,994,432 | 11/1976 | Kirby, Jr. | 229/52 B |
| 4,149,631 | 4/1979 | Cunningham | 206/158 X |
| 4,286,709 | 9/1981 | Manizza | 229/52 BC X |
| 4,303,153 | 12/1981 | Boulton | 206/435 X |
| 4,318,474 | 3/1982 | Hasegawa | 229/52 B X |
| 4,331,289 | 5/1982 | Killy | 229/52 B |

FOREIGN PATENT DOCUMENTS

| | | | |
|---|---|---|---|
| 1437404 | 11/1966 | France | 229/52 B |

*Primary Examiner*—Allan N. Shoap
*Assistant Examiner*—Bryon Gehman
*Attorney, Agent, or Firm*—Thomas L. Farquer; M. E. Click

[57] ABSTRACT

A package is disclosed comprising a rigid tray member having an upstanding peripherally located rim portion. A plurality of discrete container assemblies are within the rigid tray member. Each container assembly has a plurality of individual containers in a regular geometric array interconnected by a unitary thermoplastic carrier means. A cover shroud overlays the tray and is secured to the tray rim to complete the package.

18 Claims, 20 Drawing Figures

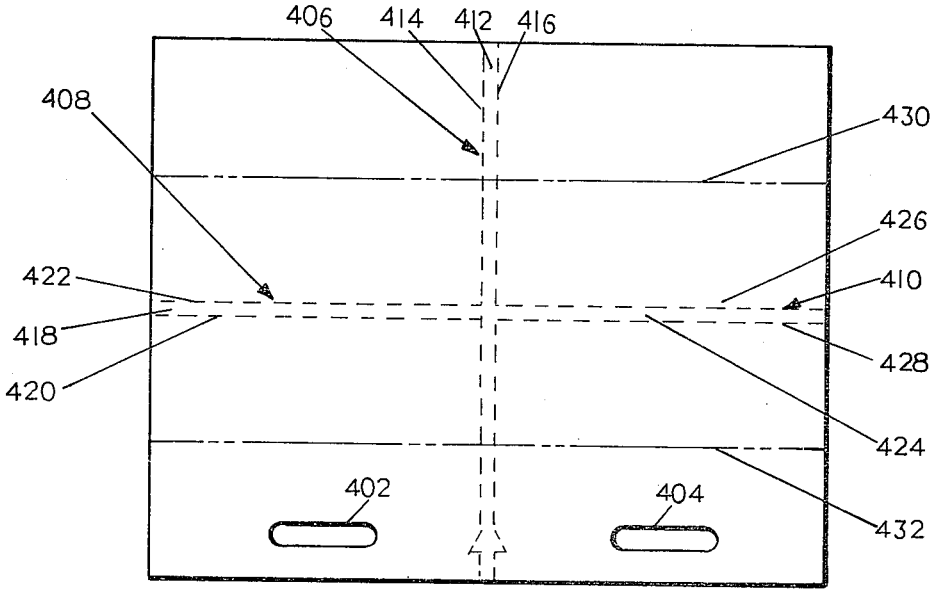
FIG. 17b
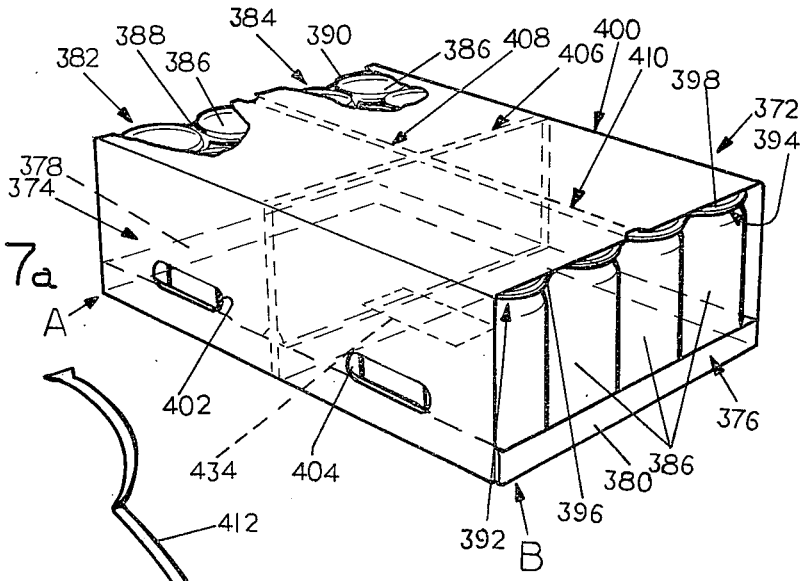
FIG. 17a
FIG. 17c
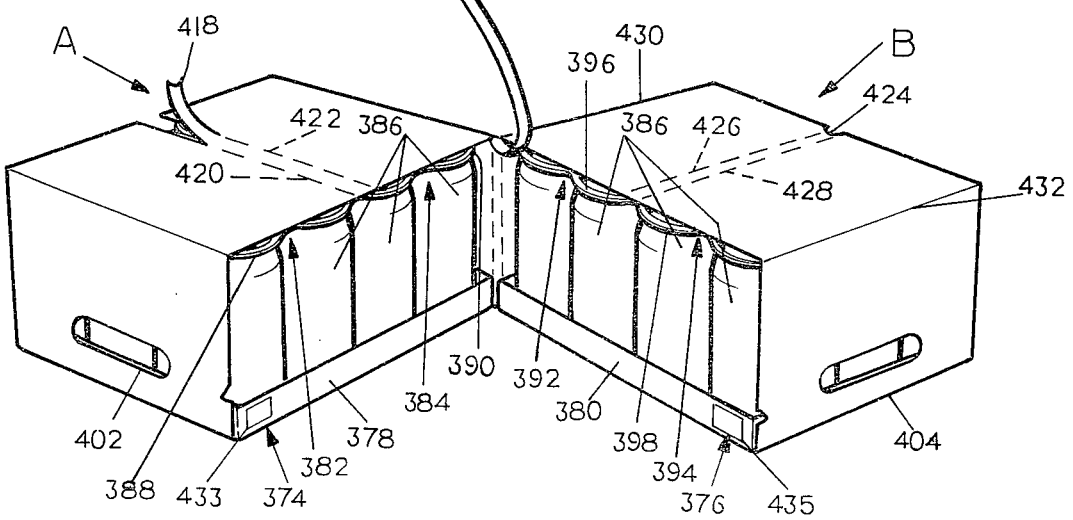

PACKAGE FOR HOLDING A PLURALITY OF DISCRETE CONTAINER ASSEMBLIES

BACKGROUND OF THE INVENTION

1. Field of the Invention

The present invention relates to packages for containing a large number of individual container units such as cans or bottles. Combination packages for holding large numbers of individual containers have been used in the past to confine and render transportable in a commercially satisfactory manner the individual containers. Prior package units have suffered from a number of commercial drawbacks. Many previously used container units have been extremely moisture sensitive when formed from paperboard material. Moisture sensitivity increases the likelihood of product identifying label detachment or in extreme cases disintegration of the package during use or transit. In either case, the package is substantially diminished in its commercial usability. Previously, arrays of metal cans, for example carbonated beverage cans or beer cans, have been transported in paperboard boxes which are not only subject to the above mentioned moisture consideration but also mechanically deformation problems. When a number of paperboard boxes containing filled cans are stacked one upon the other, as they are during shipping and store display, the uppermost peripheral rim of the cans on the bottom of the stack of paperboard boxes is forced into contact with the paperboard of the top and bottom panels of the box. After prolonged exposure to the sharp rimmed portions of the can, the paperboard, especially when moist, is subject to unacceptable groove formation which adversely affects the package. A number of approaches have been used previously to store and transport large numbers of individual articles.

2. Description of the Art

In the past, many approaches have been used for the storing and transportation of large numbers of individual articles. For example, U.S. Pat. No. 1,909,898 discloses an egg carrier adapted to have eggs arranged in the usual fillers, the carrier having handles on it by means of which the carrier together with the entire contents can be inserted in or moved from an egg crate in a single operation. The handles are so positioned as to protrude through openings formed in the crate and serve as a means to handle the crate and also as an aid in maintaining the crates in their proper stacked relationship during shipping and handling.

U.S. Pat. No. 2,959,342 discloses a package including a single strap handle means with a pair of inwardly extending tabs which engage the top portion of the main body of a package.

U.S. Pat. No. 2,975,934 discloses a packaging carrier constructed from a one-piece blank of stiff cardboard paper, paperboard or like material, formed with fold and separator lines adapted define compartments for package containment. The blank is folded into individual or multiple carrier units. The individual and multiple carrier units include multiple-ply handle members characterized by high strength and rigidity which also provide hand-gripping means for enabling the entire carrier or any selected subdivision thereof to be manually carried conveniently.

U.S. Pat. No. 3,140,008 discloses a wrapper-type can carrier having a top and bottom panel with connecting end panels which form a closed package having open sides. The end and bottom panels have a continuous split extending along the length thereof, with a strip of material detachably adhered to the bottom panel for connecting the split portions of the bottom end in the assembled position of the carrier. Also, aligned can retaining flaps are formed in the top and bottom panels with the flaps being reversely folded inwardly of the carrier and adapted for engaging the chime or rim of a can disposed therebetween. One of the aligned can retaining flaps includes a lift tab integrally connected therewith whereby a pulling motion applied to the lift tab causes the connected chimes to engage retaining flaps and the associated panel to lift away from the chime of the can retained between the referred to flaps to facilitate individual release of cans.

U.S. Pat. No. 2,293,342 discloses a box structure for carrying six cans which comprises a paperboard rectangular carton with an outstanding handle portion at one edge of the box structure. The box structure disclosed includes the feature of endwise loading of cans into the box structure.

U.S. Pat. No. 2,731,776 discloses a can carrying structure wherein cans are carried in a linear array in a package form from a one-piece blank including two subpackages. Each subpackage in the blank forms a generally rectangularly shaped containment structure with a top located handle portion. The packaging includes marginally located cutouts which allow the can chimes to fit therethrough for additional can retention within the package.

U.S. Pat. No. 2,772,044 discloses a handled carton of fiberboard or the like having side and end walls with a hinged bottom and top closure flap, a securing flap hinged to one of the walls as an extension thereto to overlap and lie flat against a portion of an adjacent wall. Further included is a carton carrying handle portion formed integrally with and extending outwardly from the extension referred to above to initially lie flat against the extension wall but adapted to be bent outwardly therefrom when in use. The package further includes means for securing the extension portion to the adjacent wall and including a pair of spaced parallel tear lines. The tear lines extend inwardly of the wall from opposed ends of the securing flap to permit a portion of the wall to be ripped open with a jerking motion. Accordingly, the package during use comprises a completely enclosed package with a tear away type handle.

U.S. Pat. No. 2,788,933 discloses a beverage case including a rectangular paperboard container having side walls, end walls and closure flaps at top and bottom portions thereof, which are folded down and secured into a closed position by an adhesive strip, staple or like means. Hand holes are located in the end walls at diagonally opposed corner portions of the beverage case with the hand holes being oblong in shape.

U.S. Pat. No. 2,848,154 discloses a conventional cardboard carton with an integral handle assembly wherein the handle assembly comprises a bifold cardboard structure with one end affixed to an edge portion of the carton and a second distal portion including an oblong handle grip.

U.S. Pat. No. 3,119,544 discloses a composite package for use with a bag-in-box resealable, flexible packaging structure including the inner flexible bag and an outer stiff cardboard package. The cardboard package includes a foldable portion which provides access to the enclosed flexible bag.

U.S. Pat. No. 3,164,316 discloses a carton of conventional, total enclosure rectangular shape including a tear away handle on one edge thereof for gripping the carton. Further included is a tear strip which is disposed about three minor sides of the carton which when engaged allows opening of the carton in a clam shell like fashion.

U.S. Pat. No. 4,303,153 discloses a thermally insulated carrying container for an assembly of beverage containers which is constructed entirely of a thin sheet of plastic foam material. The carrying container includes side flaps which are to be locatable in an open position to facilitate refrigeration and visibility of the beverages contained therein. The side flaps are also movable to a lockable, closed position to maintain the beverage containers in a cold condition for a substantial period of time. A handle means is provided to facilitate carrying of the container. A latching means is further provided between the openable top of the carrying container and the bottom of the carrying container to maintain an enclosure of a carrying container when desired.

U.S. Pat. No. 4,318,474 discloses a carton for carrying filled cans and later empty cans including a top, bottom, two sides and two end panels. One of the end panels is comprised of a three-ply laminated hand hold portion with the hand hold portion being flanked by a pair of hand holes in the end wall. The carton top includes a pair of top wall portions overlapping adjacent the center of carton and formed into a two-ply handle for carrying the carton filled with empty cans. The handle includes a pair of tabs one at each side of the handle holdable thereunder, under stress, over a row of cans disposed thereof for holding the cans in friction engagement and against lateral displacement.

SUMMARY OF THE INVENTION

The present invention relates to a package for holding a plurality of individual containers, such as cans or bottles in regular geometric arrays in container assemblies. The package according to the present invention includes a rigid tray member having a generally flat center portion and an upstanding peripherally located rim portion which extends around the entire periphery of the center portion. A plurality of discrete container assemblies are fitted within the rigid tray. Each of the container assemblies includes a plurality of individual containers in a regular geometric array. The individual containers are interconnected by a unitary thermoplastic carrier means to restrain the individual containers in the regular geometric array, for example a six-pack. A unitary, single sheet cover shroud having a center portion and at least a pair of depending, opposed unitary, single sheet side portions is connected to the tray rim to overlay the discrete container assemblies. The cover panel is spaced apart from the generally flat center portion of the tray by a distance approximately equal to the highest dimension of the discrete container assembly, to provide a snug fit for the container assemblies within the tray and cover shroud assembly. The side portions of the cover panel are connected to the upstanding perimeter rim portion of the tray. Handling means is provided for gripping and carrying the package.

The package according to the present invention is particularly advantageous in that it substantially reduces problems due to using composite packages in high moisture areas, also, problems related to stacking of a large number of packages, one on top of the other, for shipping and storage. Further, due to the minimal number of parts and minimal forming operation steps, the package of the present invention is relatively inexpensive to produce. Additionally, the package of the present invention provides easy access means to the enclosed container assemblies by means of a severable tear-tab on the cover shroud. Also, after opening the package, a portion of the cover shroud acts as a empty container restraining means to render the package returnable where statutes provide for return of all soft drink and beer containers after use. Further, the present package does not rely on an interference fit type tuck in tab for structural integrity. Such tabs cause severe continuous operation problems in high speed packaging production lines.

BRIEF DESCRIPTION OF THE DRAWINGS

The advantages of the package according to the present invention will become readily manifest to those skilled in the art from reading the following detailed description of the invention, when considered in view of the accompanying drawings, in which:

FIG. 17*a* is a perspective of an alternative embodiment of the present assembled package;

FIG. 17*b* is a top plan view of the cover shroud for the invention illustrated in FIG. 17*a;*

FIG. 17*c* is a perspective view of a severed package as illustrated in FIG. 17*a;*

DESCRIPTION OF THE PREFERRED EMBODIMENTS OF THE INVENTION

Figure 1:
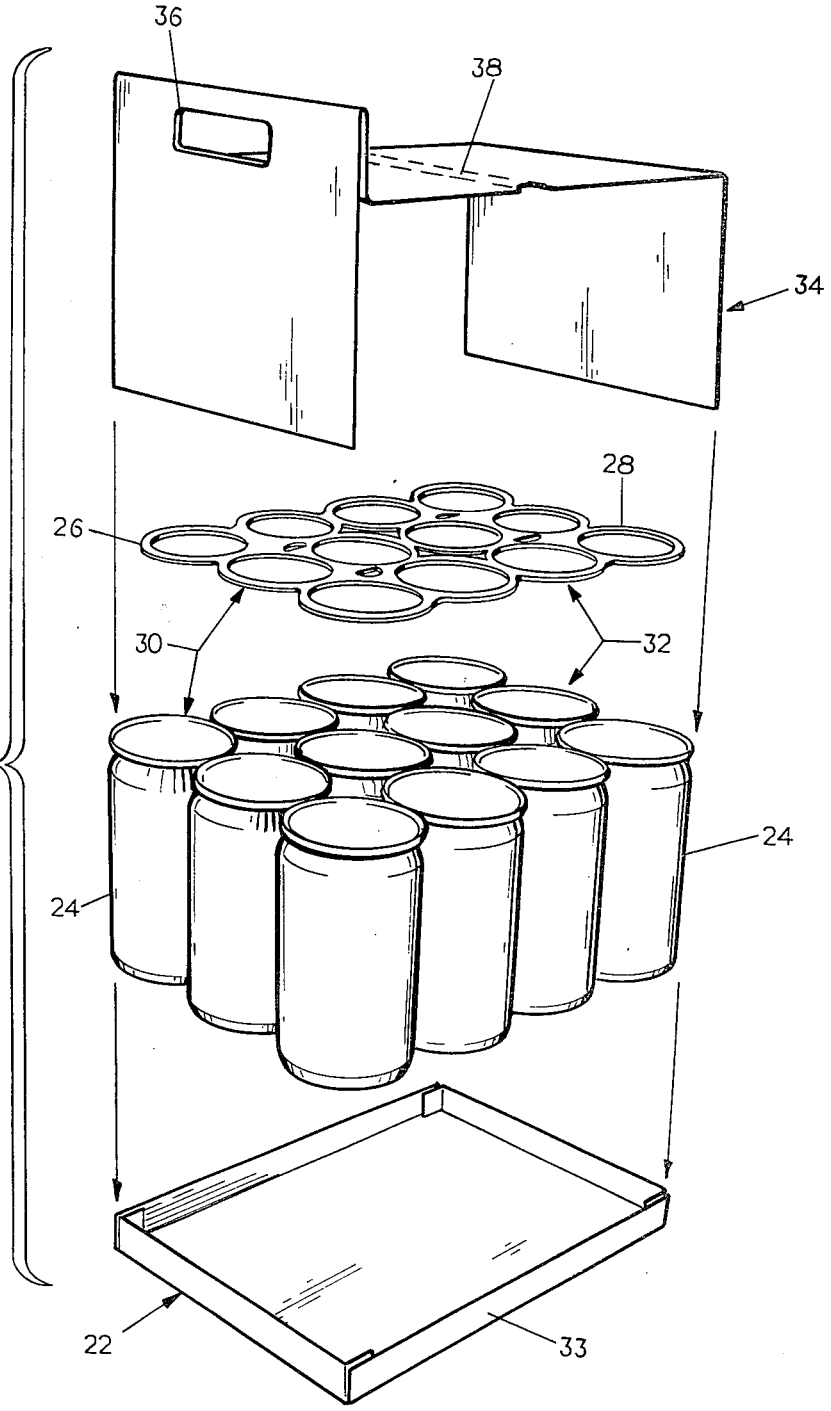
FIG. 1 is an exploded perspective view of the package of the present invention.

Referring to the drawings illustrating the advantages of the present package, there is illustrated in the figures a package for holding a plurality of individual containers arranged in regular geometric arrays in discrete container assemblies. Referring specifically to FIGS. 1–4, there is illustrated a package 20 including a tray 22. The tray 22 contains and partially encases a plurality of cans 24. The cans 24 are grouped into discrete container assemblies which are held in the tray 22. The discrete container assemblies 30 and 32 include a plurality of cans 24 within each of the carrier means 26 and 28. The container assemblies 30 and 32 fit within the tray 22 and are held therein partially by an upstanding tray rim 33. A single sheet unitary cover shroud 34 overlies the container assemblies 30 and 32 and is secured to opposed edges of the tray rim 33. Typically a hot melt adhesive or metal staples are suitable to secure the cover shroud 34 to the tray rim 33. The single sheet cover shroud 34 includes a flap type handle portion 36 and a severable portion 38. The severable portion 38 provides for convenient access to the container assemblies 30 and 32 upon use of the package 20.

Figure 2:
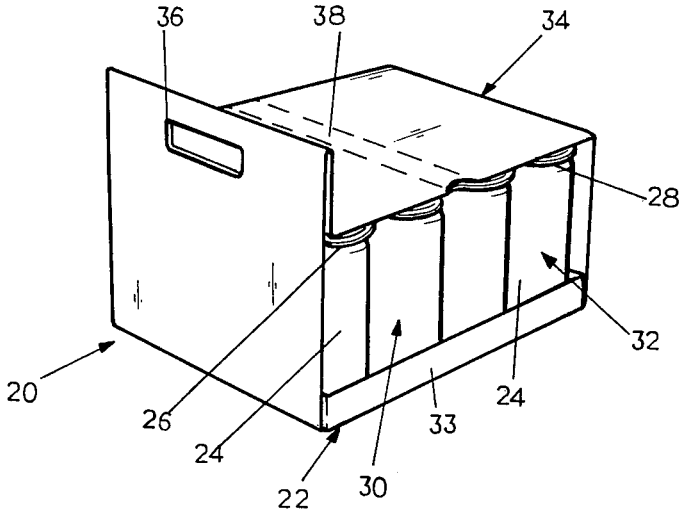
FIG. 2 is a perspective view of the assembled package illustrated in FIG. 1.
Figure 3:
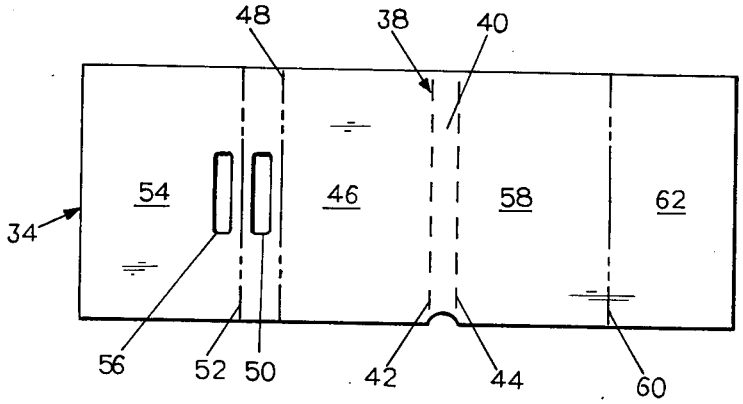
FIG. 3 is a top plan view of the cover shroud of the present invention.

Referring specifically to FIG. 3, there is shown a top plan view of the single sheet cover shroud 34 of the present invention. The cover shroud 34 is typically fabricated from double strength, high wet strength, paperboard packaging material. The paperboard material is printed with product advertising information and subsequently overcoated for additional scuff and abrasion protection. Any suitable paperboard varnish coating is acceptable for use with the present invention. The material in the preferred embodiment is approximately twenty-six mil thick. Such a thickness provides acceptable strength and stiffness characteristics without unnecessary cost. However, any suitable material may be used for the cover shroud 34, for example, thin sheet polyolefin materials, such as, polyethylene or polypropylene plastic. The cover shroud 34 is usually fabricated with a single stamping die which cuts the cover shroud 34 from a continuous length of paperboard feed stock. The cover shroud 34 is generally rectangularly, as shown in the preferred embodiment illustrated in FIGS. 1–4. In the preferred embodiment of the invention the cans 24 are groups within each container assembly 30 and 32, into a pair of three can linear arrays as shown, to form a so-called six pack. Any alternative geometric array is suitable.

The cover shroud 34 illustrated in FIG. 3 includes the severable portion 38 discussed above which provides convenient access to the container assemblies 30 and 32. The severable portion 38 is integral with the cover shroud 34 and includes a center tear strip 40 bounded on each side by the perforated score lines 42 and 44. Immediately adjacent score line 42 is a primary flap portion 46. The primary flap portion 46 blends into a fold line 48. The fold line 48 is adjacent to a handle aperture portion 50. The handle aperture portion 50 merges with a fold line 52. Adjacent to fold line 52 is a first side portion 54 which includes a handle aperture portion 56. Adjacent the score line 42 is a secondary flap portion 58 which terminates at the fold line 60. The fold line 60 connects with a second side portion 62. The portions 50 and 56, when secured togther by suitable means, cooperate to form the outstanding flap which comprises the handle portion 36.

Figure 4:
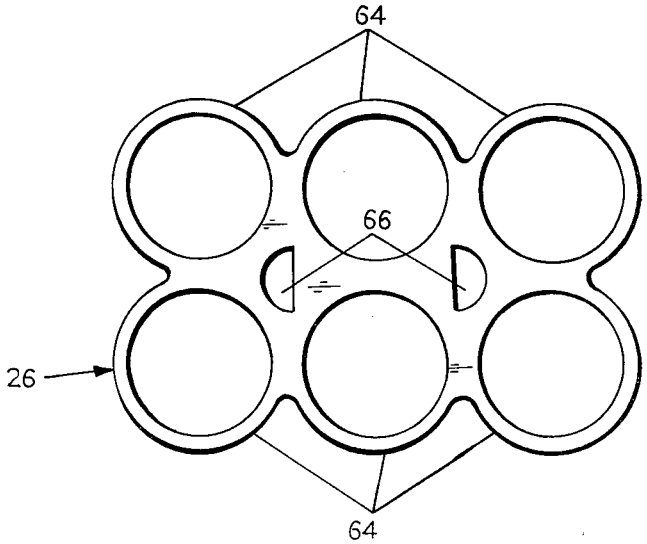
FIG. 4 is a top plan view of the thermoplastic carrier means illustrated in FIG. 1.

FIG. 4 illustrates a top plan view of one of the thermoplastic carrier means 26 illustrated in FIGS. 1 and 2. The carrier 26 is typically a unitary, die cut, thermoplastic material structure. The carrier 26 is typically fabricated from low density polyethylene plastic due to their low cost and high mechanical strength and excellent elastic recovery characteristics. The carrier 26 in the preferred embodiment includes a plurality of peripherally located can top restraining portions 64 and a centrally located hand grip portion 66. The carrier 26 is disposed above a plurality of cans 24 with a regular geometric array matching the geometric array of the can top retaining portion 64. Subsequently, the carrier 26, which is cold, is stretched open by mechanical fingers and is lowered onto the geometric array of cans 24. The fingers are retracted and by the elastic recovery of the material, a frictional engagement with the cans 24 is achieved to result in the container assembly 30.

One of the advantages provided by the present invention is the reduction of package degradation by substantial indentation into the package by the chimes or rims of the cans 24. The tray 22 in the preferred embodiment of the invention is made from a high strength corrugated paper product which can effectively absorb any indentations by the rims of the cans 24 during shipping and storage. Accordingly, when packages 20 are stacked one on top the other for shipping and storage, the lower rims of the cans 24 are forced into the corrugated matrix on the inside of the tray 22 such that the tray absorbs the circular indentation formed by the rims. In the case of an immediate subjacent package 20, the top surface of the cover shroud 34 is in contact with the upper rim of the cans 24. However, due to the rigidity of the corrugated tray material for the tray 22 immediately above and in contact with the top of the cover shroud 34 of the lower package 20, only minimal indentations by can rims are possible. Accordingly, the bottom of the package is protected from substantial indentations by can chimes by the use of the tray 22 of a thicker material, having more rigidity and indentation absorbing capabilities than the material used for the cover shroud. Such a fabrication expedient lowers the overall cost of the package substantially without reducing the structurally integrity or aesthetic character of the package. The indentation created by the can rims on the corrugated tray are on the inside and thus invisible from the exterior of the package.

Figure 5A:
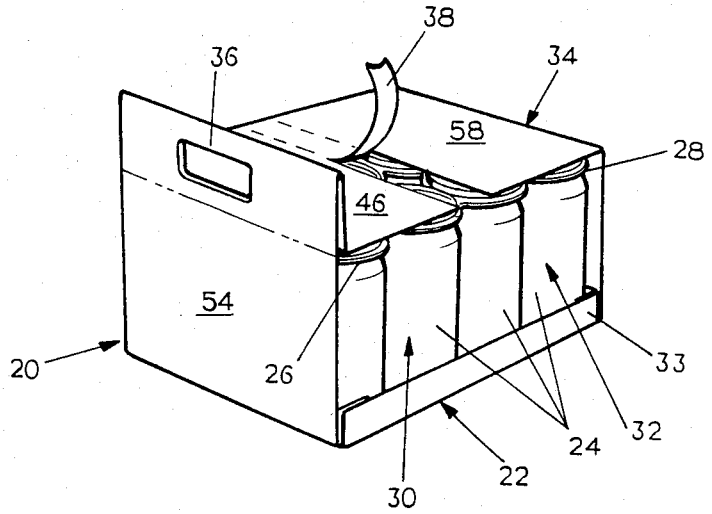
FIG. 5*a–c* is a schematic representation of the use of the package illustrated in FIG. 1.
Figure 5B:
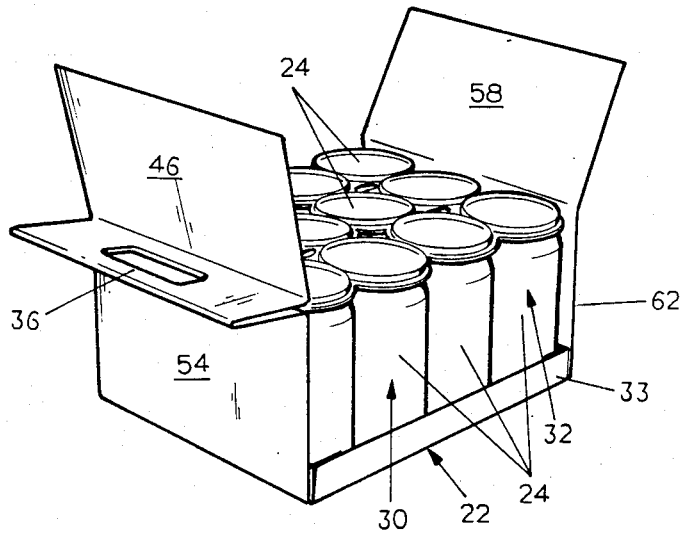
Figure 5C:
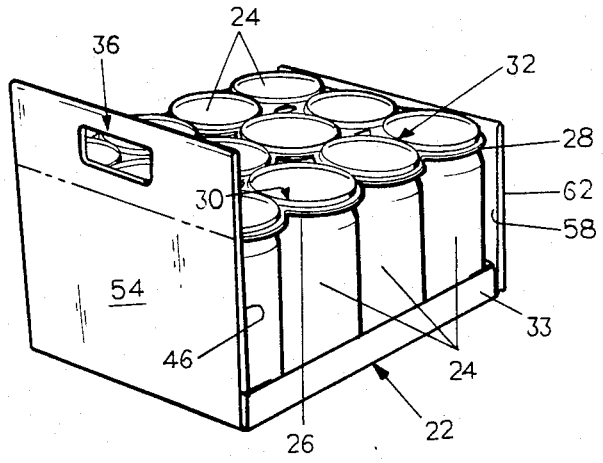

FIGS. 5*a–c* illustrate a schematic view of the use of the package 20 of the present invention. At FIG. 5*a* is illustrated the package 20 of the present invention showing the severable portion 38 being removed from the center of the cover shroud 34. After the severable portion 38 is removed and discarded, the package 20 is opened providing access to the container assemblies 30 and 32. The container assemblies 30 and 32 can be removed individually for refrigeration and use. The primary flap portion 46 and secondary flap portion 58 are folded inwardly of the tray 22 and placed adjacent to the first side portion 54 and second side portion 62, respectively. The inward folding of the primary flap portion of 46 and secondary flap portion 58 provides a spring biasing effect so that the cans 24, when emptied of contents, may be returned to the tray 22 for storage and subsequent return to the place of purchase. This is particularly advantageous in areas where it is legally required to sell only returnable containers for environmental reasons. The spring biasing of the primary and secondary flap portions 46 and 58, respectively, provides a mechanism of holding the empty cans 24 in the tray 22, with the assistance of the first and second side portions, 54 and 62 respectively, for ease of return of the empty cans 24.

Figure 6:
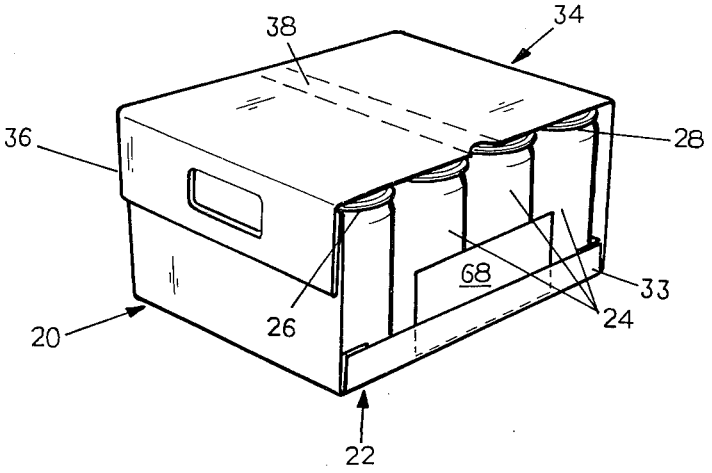
FIG. 6 is a perspective view of the invention illustrated in FIG. 1, including a promotional insert card with the handle flap in the down position.

FIG. 6 illustrates a perspective view of an embodiment of the invention illustrated in FIGS. 1–5 wherein a promotional advertising card 68 is affixed to the internal surface of the upstanding rim portion 33 of the tray 22. The card is inserted between the innerwall of the upstanding tray rim 33 and the cans 24 and either held by friction, an adhesive or metal staples. FIG. 6 illustrates the handle portion 36 in the folded down position to avoid obstruction on the conveyor line during assembly of the package. An adhesive can be used to hold the handle portion 36 down until consumer use is required.

Figure 7:
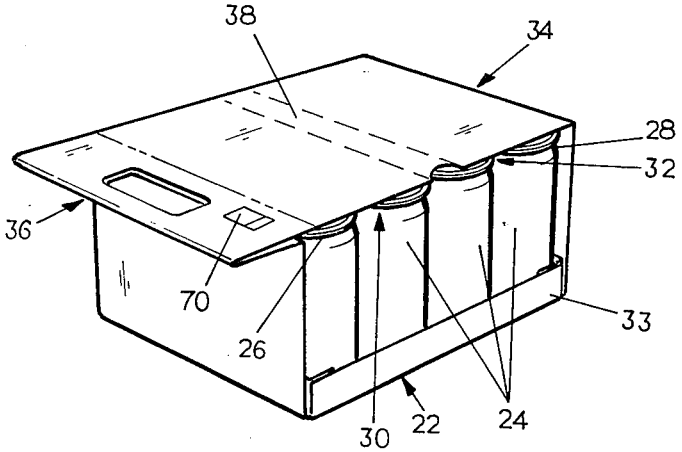
FIG. 7 is a perspective view of the invention illustrated in FIG. 1, including a product-identifying portion.

An alternative embodiment of the invention of FIGS. 1–5 is illustrated in the perspective view at FIG. 7. A product identifying label 70 is disposed on one major surface of the flap type handle portion 36. In the embodiment of the invention shown in FIG. 7, the product label is a unit product code, computer scannable product identifying label. Such unit product code labels are read by computer scanning devices to militate against the individual price stamping of each article of commerce. Such unit product code can be directly printed on the handle portion 36 or separately prepared and affixed to the handle portion 36 with suitable adhesive.

Figure 8:
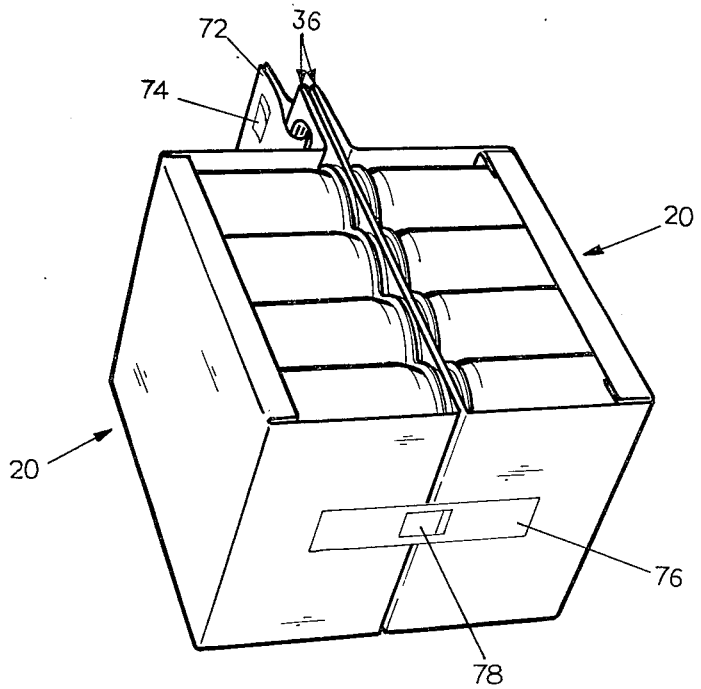
FIG. 8 is a perspective view of a modified embodiment of the present invention.

FIG. 8 is a perspective view of an alternative embodiment of the package according to the present invention wherein a pair of packages 20 are secured together by a primary closure means 72 having disposed thereupon a product identifying label 74, and a secondary closure means 76 bearing a secondary product identifying label 78. Only one product identifying label, either label 74 or 78 need be used. However, both may be used if desired. The primary closure means 72 is typically a unitary die cut paper portion which is looped through the adjacent handle portions 36 and secured together at its end to form a unitary primary closure means 72. Thereafter, the product identifying label 74, typically a unit price code identifying label, is affixed to the primary closure means 72. Similarly, the second closure means 76 is a unitary die cut paper portion with a product identifying label 78 affixed thereto. The closure means 76 is adhesed or stapled to the abutting end portion of the packages 20.

Figure 9A:
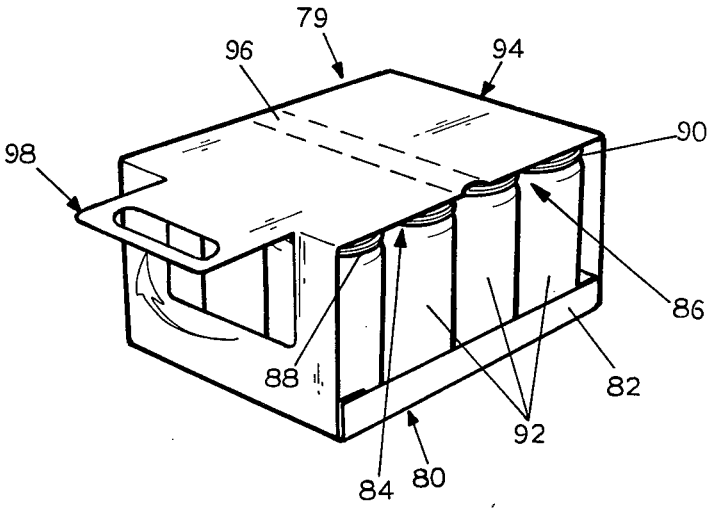
FIG. 9*a* is a perspective view of an alternative handling means for the package of the present invention.
Figure 9B:
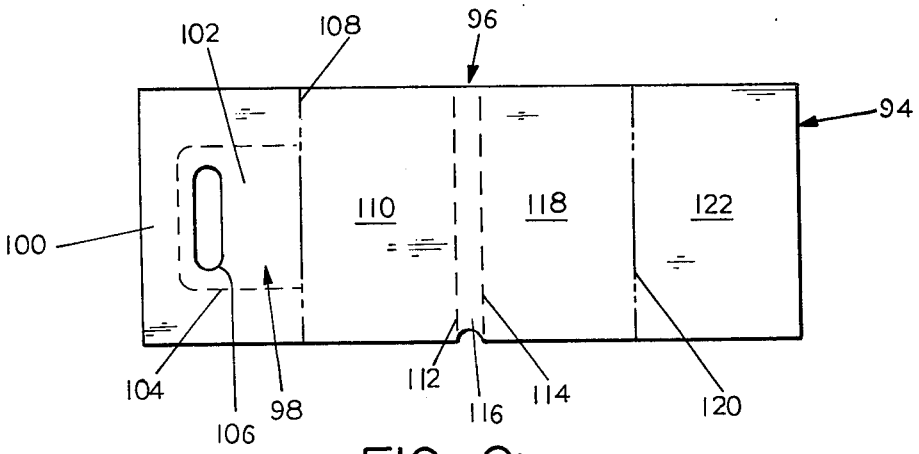
FIG. 9*b* is a top plan view of the cover shroud of the embodiment of FIG. 9*a;*

FIG. 9*a* illustrates a perspective view of an alternative handling means for the present package. A package 79, illustrated in FIGS. 9*a–b* includes a tray portion 80 having an upstanding tray rim 82. Placed within the confines of the tray rim 82 are a pair of discrete container assemblies 84 and 86. The container assembly 84 includes a carrier means 88 encasing a plurality of cans 92 in a regular geometric array. The container assembly 86 includes a carrier means 90 encasing a plurality of cans 92. Overlying the container assemblies 84 and 86 is a unitary single sheet cover shroud 94. The cover shroud 94 includes an integral severable portion 96 allowing convenient access to the container assemblies 84 and 86. The cover shroud also includes a flap type handle portion 98. As most clearly shown in FIG. 9*b*, a top plan view of the cover shroud 94 of the package 79, the cover shroud 94 includes a first side portion 100. The handle portion 98 is included within the first side portion 100 and includes a hand grip portion 102 bordered by a score line 104 and including the cutout aperture 106 for ease of gripping. The first side portion 100 terminates at the fold line 108. A first flap portion 110 extends from the fold line 108 and terminates at a score line 112. The score line 112 and a second score line 114 form the boundaries of the severable portion 96 and encase the center tear tab 116. Extending from the score line 114 is a second flap portion 118 which terminates at the fold line 120. A second side portion 122 connects with the fold line 120 to form the unitary single sheet cover shroud 94. After the package 79 has been assembled, the handle portion 98 is activated by placing the hand through the aperture 106 and pulling upwardly and outwardly to cause the score line 104 to separate from the first side portion 100 generating the independent outstanding handle portion 98 as illustrated at FIG. 9*a*.

Figure 10A:
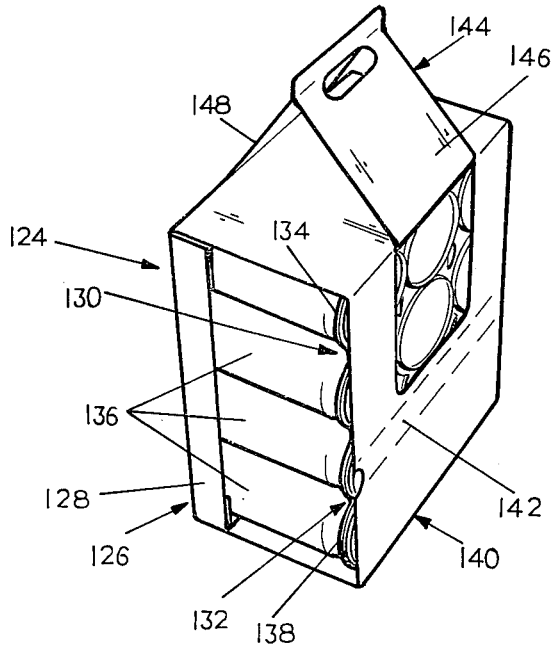
FIG. 10*a* is a perspective view of an alternative handling means for the package of the present invention.
Figure 10B:
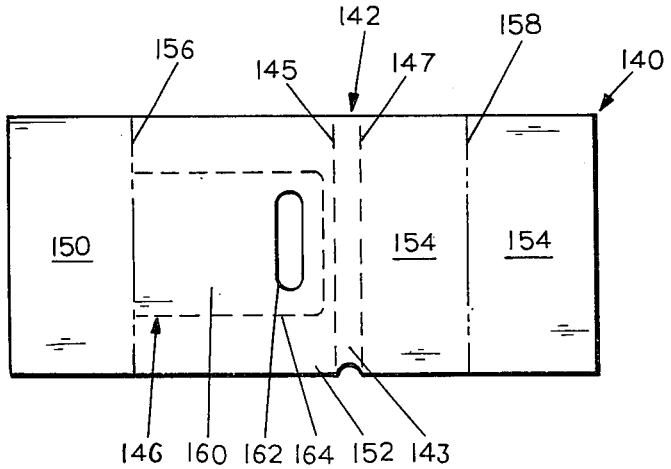
FIG. 10*b* is a top plan view of the cover shroud illustrated in FIG. 10*a;*
Figure 10C:
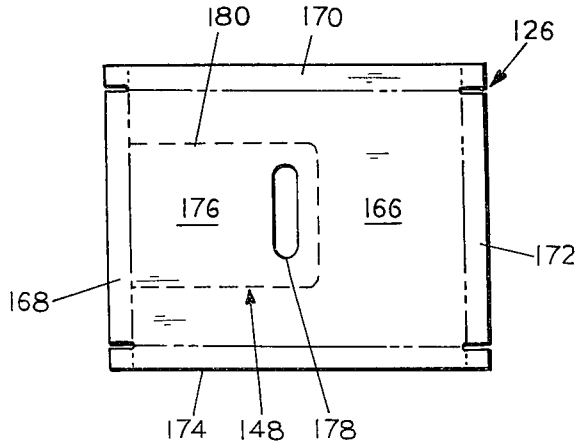
FIG. 10*c* is a top plan view of the tray portion of the package illustrated in FIG. 10*a;*

Another embodiment of the package according to the present invention is illustrated in FIGS. 10*a–c*. FIG. 10*a* illustrates a package 124 including a tray 126 having an upstanding tray rim 128. A pair of container assemblies 130 and 132, respectively, are contained within the upstanding rim 128 of the tray 126. The container assembly 130 includes a carrier means 134 encasing a plurality of cans 136 in a regular geometric array. The container assembly 132 includes the carrier 138 encasing an analogous plurality of cans 136 to those contained by carrier means 138. A unitary single sheet cover shroud 140 overlies the container assemblies 130 and 132 and is attached to opposing ends of the tray 126. The cover shroud 140 includes an integral severable means 142 for providing convenient access to the container assemblies 130 and 132. The cover shroud 140 also includes a flap like handle portion 144 having a first handle portion 146 and a second handle portion 148.

FIG. 10*b* is a top plan view of the cover shroud 140 of the invention illustrated in FIG. 10*a*. The cover shroud 140 includes a first side portion 150, a center portion 152 and a second side portion 154. The portions 150 and 152 are joined by a fold line 156 while the portions 152 and 154 are joined by a fold line 158. The first handle portion 146 of the handle means 144 includes a hand grip 160 which includes an aperture 162. The hand grip 160 is separated from the remainder of the center portion 152 by a score line 164. The integral severable means 142 includes a tear tab 143 which is joined to the portions 152 and 154 by a pair of score lines 145 and 147.

FIG. 10*c* is a top plan view of the unitary, die cut, tray 126, prior to assembly and illustrates the features of the tray 126 including a center panel 166. The center panel 166 has four peripherally located tabs, 168, 170, 172 and 174. The tabs 168–174 are folded upwardly and secured together to form the upstanding tray rim 128 of the tray 126. The center portion 166 of the tray 126 further includes the second handle portion 148. The second handle 148 includes a hand grip 176 which includes an aperture 178. The hand grip 176 is separated from the remainder of the center portion 166 by score line 180.

When the package 124 illustrated in FIGS. 10*a–c* is assembled and shipped, the handle portions 146 and 148 are not detached from their respective portions of the package 124. Upon use, the consumer grips the handle portions 146 and 148 and severs them from the remainder of the package 126 along with score lines 164 and 180, respectively, to generate the bipartate handle means 144. The portions 162 and 178 are so disposed on portions 140 and 126, respectively, as to fold into contact such that the portions 162 and 178 are in registry to form a hand grip.

Figure 11A:
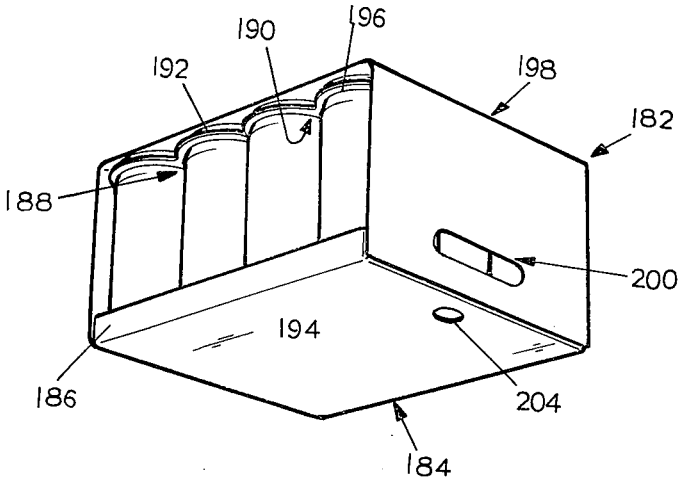
FIGURE 11*a* is a perspective view of an alternative handling means for the package of the present invention.
Figure 11B:
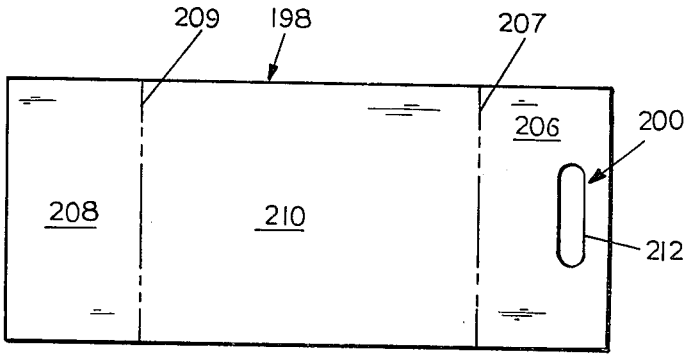
FIGURE 11*b* is a top plan view of the cover shroud of the package illustrated in FIG. 11*a;*
Figure 11C:
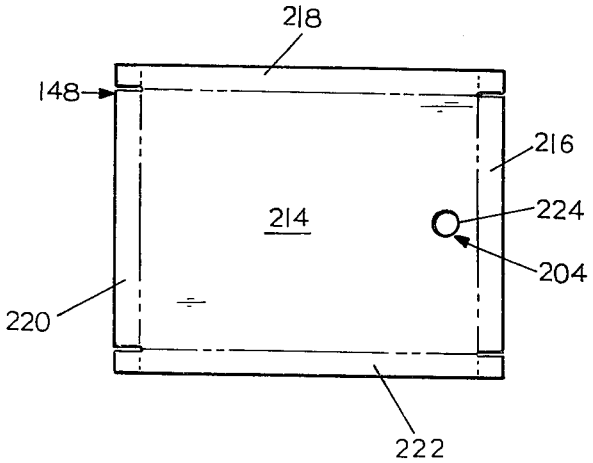
FIGURE 11*c* is a top plan view of the tray portion of the package illustrated in FIG. 11*a;*

FIGS. 11*a–c* illustrate an alternative embodiment of a handle means useful with the present invention. As illustrated most clearly in FIG. 11*a*, a package 182 includes a tray 184 having an upstanding tray rim 186. Contained within the tray 184 are a pair of container assemblies 188 and 190. The container assembly 188 includes a carrier means 192 which encases a plurality of cans 194 in a regular geometric array. The second container assembly 190 includes a carrier means 196 which similarly encases a plurality of cans 194 in a regular geometric array. Overlaying both container assemblies 188 and 190 and secured to opposing ends of the tray 184 is a cover shroud 198. The cover shroud 198 includes a first handle means 200. A second handle means 204 is included in the tray 184.

FIG. 11*b* illustrates a top plan view of the cover shroud 198 of the package 182. The cover shroud 198 includes a first side portion to 206, a second side portion 208 and an intermediate center portion 210 joining the side portions 206 and 208 by fold lines 207 and 209. The first handle portion 200 includes the aperture 212 which is a generally elongate slot in the first side portion 206. The center portion 210 of the cover shroud 198 may include an integral severable means (as illustrated and described above at FIGS. 1, 6 and 9) if desired.

FIG. 11*c* illustrates a top plan view of the tray 184 of the package 182 including a center tray portion 214. The center portion 214 includes four peripherally located tabs 216, 218, 220 and 222, respectively, which are folded upwardly and inwardly and sealed with suitable adhesive or staples to form the tray rim 186. The center portion 214 includes the second handle portion 204 which includes the circularly shaped thumb slot aperture 224.

Figure 12A:
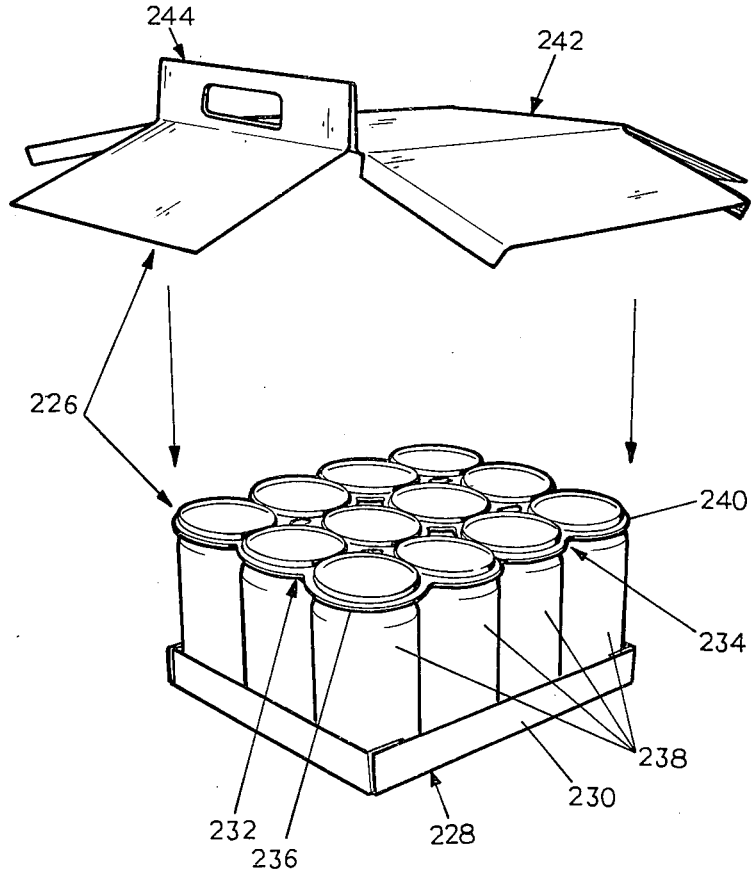
FIG. 12*a* is a perspective view of an alternative embodiment of the package of the present invention.
Figure 12B:
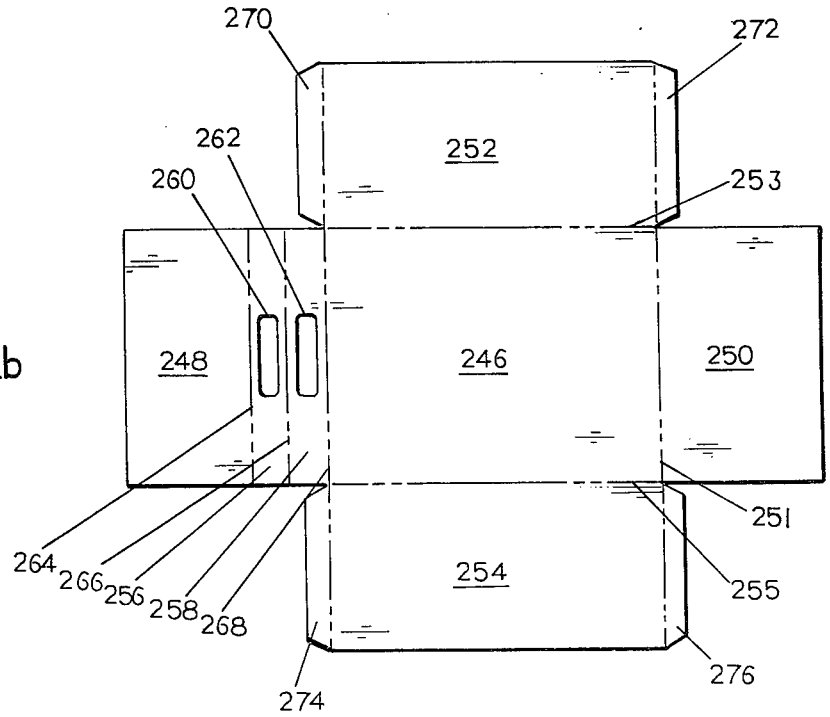
FIG. 12*b* is a top plan view of the cover shroud of the package illustrated in FIG. 12*a;*

FIGS. 12*a–b* illustrates an embodiment of the present invention for total encasement of the individual containers in the discrete container assemblies. Illustrated is a package 226 including a tray 228 having an upstanding tray rim 230. Contained within the tray 228 are a pair of container assemblies 232 and 234. The container assembly 232 includes a carrier 236 which encases a plurality of regularly arrayed cans 238. The container assembly 234 includes the carrier 240 which encases a plurality of regularly arrayed cans 238 also in a regular geometric array. Overlying the container assemblies 232 and 234 is a cover shroud 242 including a flap type handle portion 244. The cover shroud 242 is a total encasement type of shroud, illustrated in plan view at FIG. 12*b*. The cover shroud 242 includes a top panel 246, a first pair of opposed panels including a front panel 248, a rear panel 250 and a second pair of panels, namely, opposed side panels 252 and 254, respectively. The front panel 248 includes a first handle portion 256 and a second handle portion 258, each including apertures 260 and 262 respectively. The first handle portion 256 is bounded by a fold line 264 and a fold line 266. The second handle portion 256 is bounded by the fold line 266 and a fold line 268, which joins it to the top panel 246. The side panel 252 includes a pair of tabs 270 and 272 respectively while the side panel 254 also includes a pair of outstanding tabs 274 and 276. The side panel 252 merges with the center panel 246 along fold line 253 while side panel 254 merges with the center panel 246 along fold line 255. A fold line 251 connects panel 250 to panel 246. In assembling the package 226, the tabs 270-276 are folded inwardly so that they may be joined to and secured with the front panel 248 and the rear panel 250 to form the unitary total encasement cover shroud 242. In this embodiment of the invention, the internally housed container assemblies 232 and 234 are protected to the utmost degree from external factors such as moisture and sunlight which can adversely affect contained foodstuffs and the like. Also, this embodiment of the invention provides superior billboard area for product advertisement.

Figure 13:
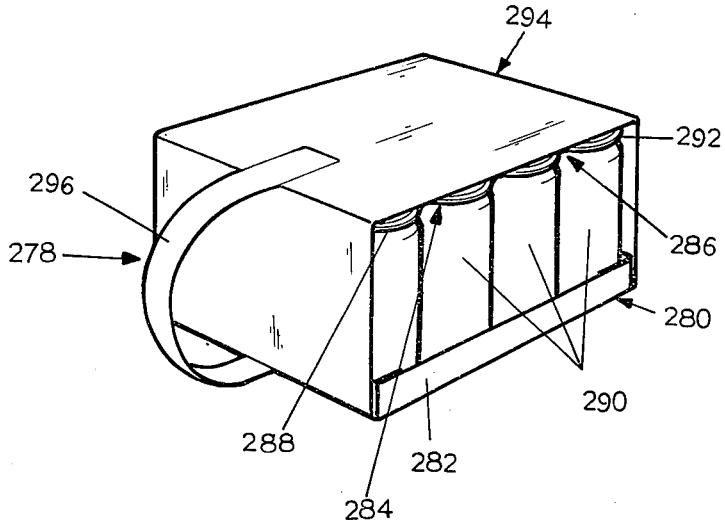
FIG. 13 is a perspective view of an alternative handling means for the package of the present invention.

FIG. 13 illustrates a perspective view of an alternative handling means for the package according to the present invention. Illustrated is a package 278 including a tray portion 280 having an upstanding tray rim 282. Contained within the upstanding tray rim 282 are a pair of container assemblies 284 and 286. The container assembly 284 comprises a carrier 282 securing together a plurality of cans 290 in a regular geometric array. The container assembly 286 includes the carrier means 292 similarly encasing a regular array of cans 290. Overlying the container assemblies 284 and 286 and secured to the tray 280 at opposed ends is a single sheet cover shroud 294 including handle means 296. The handle means 296 is usually a single strip of paperboard or plastic. In the embodiment of the invention illustrated in FIG. 13, the handle means 296 includes a single strap of paper or plastic materials secured at both ends to the package 294. In the embodiment of FIG. 13, one end of the handle means 296 is secured by adhesive or stapling to the cover shroud 294 while the opposing end of the handle means 296 is secured to the tray 280.

Figure 14A:
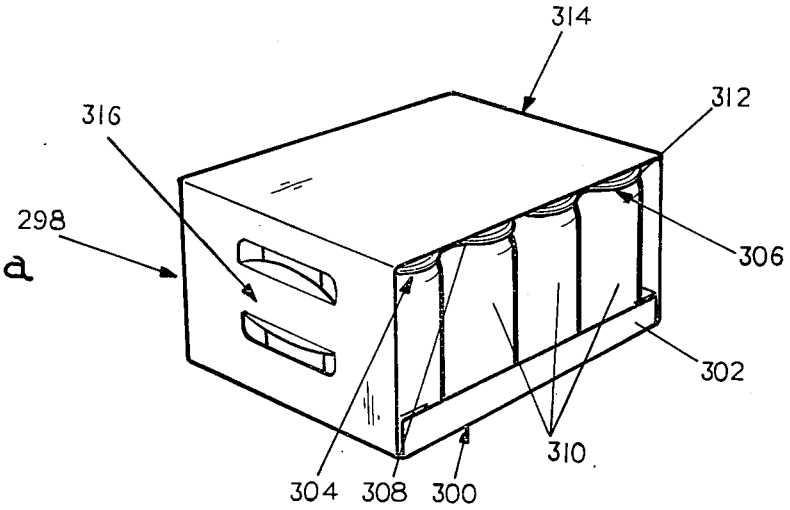
FIG. 14*a* is a perspective view of an alternative handling means for the package of the present invention.
Figure 14B:
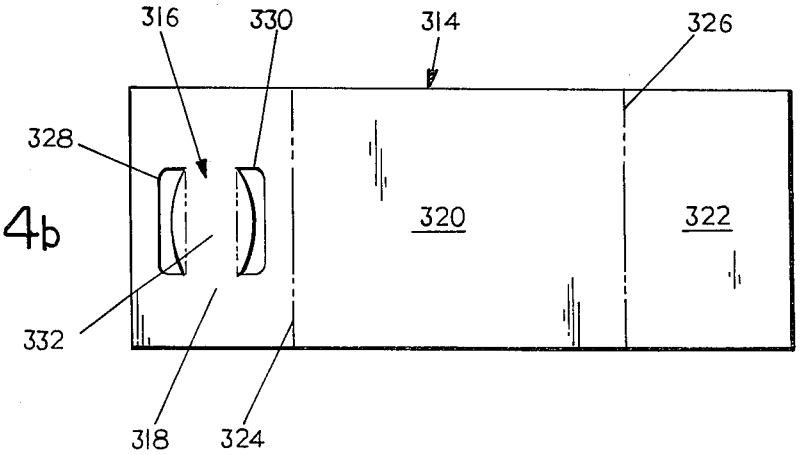
FIG. 14*b* is a top plan view of the cover shroud of the invention illustrated in FIG. 14*a;*

FIG. 14 illustrates a perspective view of an alternative package according to the present invention wherein a package 298 includes a tray 300 having an upstanding tray rim 302. A pair of container assemblies 304 and 306 are positioned within the tray 300. The container assembly 304 includes a carrier 308 which encases a regular geometric array of cans 310. Similarly, the container assembly 306 includes a carrier 312 which contains a regular geometric array of cans 310, similar to the carrier 308. A cover shroud 314 overlays the container assemblies 304 and 306 and is secured to the upstanding tray rim 302 at opposed ends of tray 300. The cover shroud 314 includes handle means 316 for grasping the package 298. FIG. 14*b* illustrates a top plan view of the cover shroud 314 of the package 298. The cover shroud 314 includes a first side portion 318, a center portion 320 and a second side portion 322. The portion 318 and 320 are connected to each other by fold line 324. Similarly, the portions 320 and 322 are connected to one another by a fold line 326. A pair of apertures 328 and 330 are disposed within the first side portion 318 and form the hand grip 332. In the embodiment of the invention illustrated in FIGS. 14*a–b*, the handle means 316 is disposed upon a side portion, for example the side portion 318, which is secured to one of the opposed short ends of the tray 300.

Figure 15A:
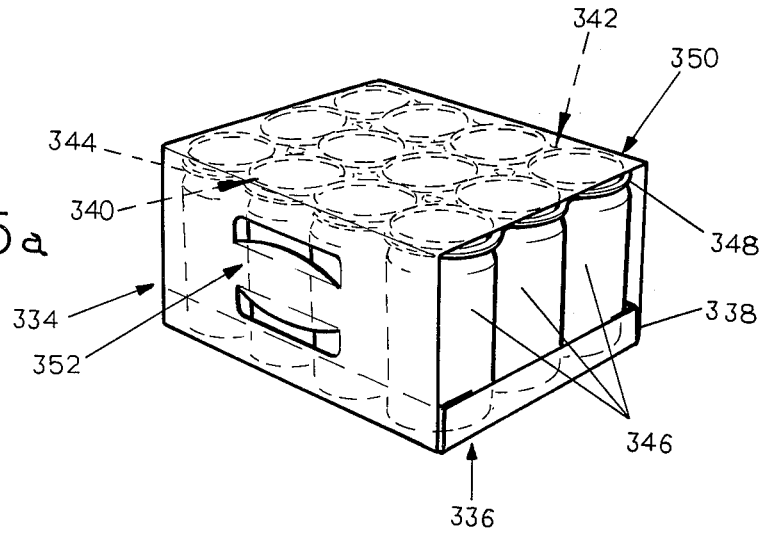
FIG. 15*a* is an alternative embodiment of a handling means for the package illustrated in FIG. 14.
Figure 15B:
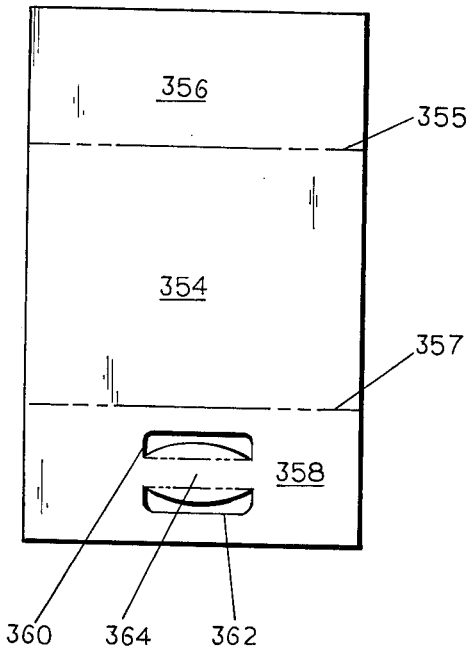
FIG. 15*b* is a top plan view of the cover shroud illustrated in FIG. 15*a;*

FIGS. 15*a–b* illustrate another embodiment of the invention illustrated in FIGS. 14*a–b* wherein a handle means is secured along one of the long edges of a tray. Specifically, FIG. 15*a* is a perspective view of a package 334 according to the present invention including a tray 336 having an upstanding tray rim 338. Contained within the tray 336 are a pair of container assemblies 340 and 342. The container assembly 340 includes a carrier 344 which holds a regular geometric array of cans 346. The container assembly 342 includes a carrier 348 which similarly encases a regular geometric array of cans 346. Overlaying the container assemblies 340 and 342 and secured to the longest edges of the tray 336 is a cover shroud 350. The cover shroud 350 includes handle means 352. As shown at FIG. 15*b*, the cover shroud 350 includes a center portion 354, a first side portion 356 and a second side portion 358. A pair of apertures 360 and 362 are disposed along the second side portion of 358 and surround a hand grip 364 which portions form the handle means 352. The portions 356 and 354 are joined by a fold line 355. Similarly, a fold line 357 joins the portion 354 to the portion 358. The cover shroud 350 may include an integral severable means as illustrated in FIGS. 1, 6 and 9, if desired.

Figure 16A:
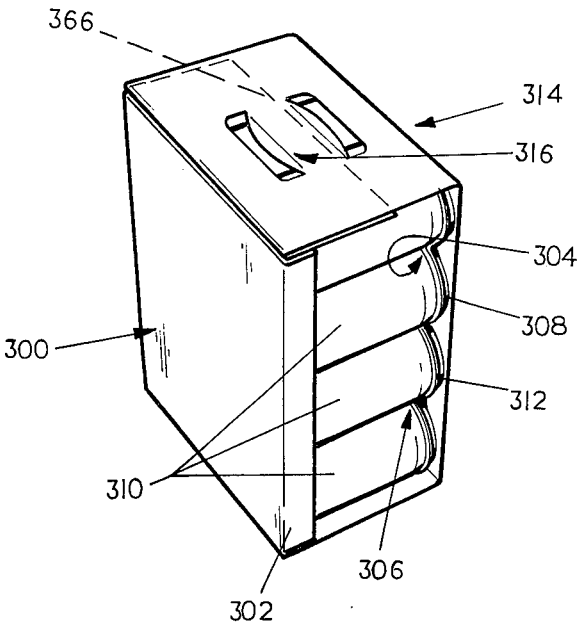
FIG. 16*a* is a perspective view of an alternative embodiment of a handling means illustrated in FIGS. 14–15.
Figure 16B:
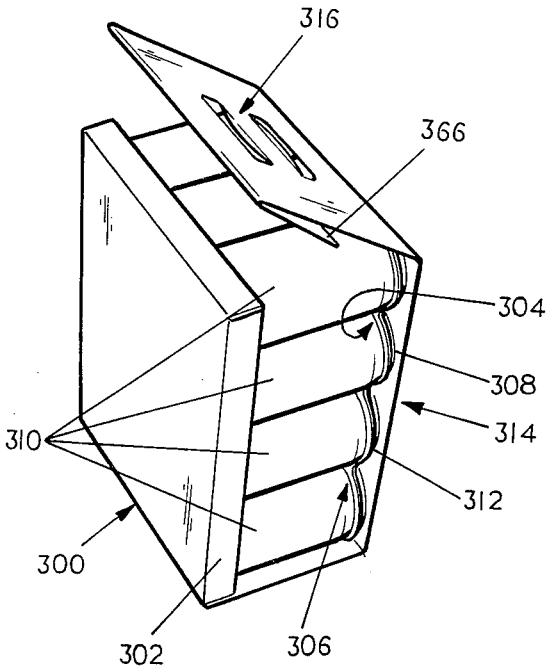
FIG. 16*b* illustrates the assembly step for the invention illustrated in FIG. 16*a*.
Figure 16C:
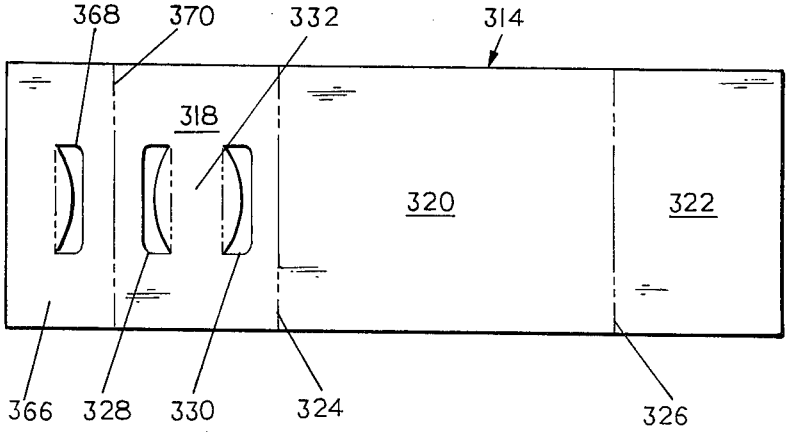
FIG. 16*c* is a top plan view of the cover shroud for the invention illustrated in FIG. 16*a–b.*

An alternative embodiment of the invention illustrated in FIGS. 14*a–b* is illustrated in FIGS. 16*a–c*, wherein like reference numerals designate like structure. The embodiment of the package according to the present invention illustrated in FIGS. 16*a–c* include a return portion 366 and an aperture 368 in the return portion. The return portion 366 is secured to the first side portion 318 of the cover shroud 314 by a fold line 370. The return portion 366 is folded so that it contacts the inner surface of the first side portion 318 and extends to the mid-point of the hand grip portion 332 of the first side portion 318. The return portion 366 is secured to the first side portion 318 by hot melt adhesive or metal staples and provides substantial reinforcement for the hand grip portion 332 of the package 298. The cover shroud 314 may include an integral severable means as illustrated in FIGS. 1, 6 and 9, if desired.

FIGS. 17*a–c* illustrates an alternative embodiment of the present invention in which 24 cans may be contained, shipped and stored together. FIG. 17*a* illustrates a packgage 372 including a first tray 374 and a second tray 376. Tray 374 includes an upstanding rim 378 while tray 376 includes an upstanding rim 380. A pair of container assemblies 382 and 384 are disposed within the first tray 374. The container assembly 382 includes a regular array of cans 386 secured together at their uppermost edge by a carrier 388. A second carrier 390 is included in the container assembly 384, securing together a similar array of cans 386.

A second pair of container assemblies, namely container assembly 392 and container assembly 394, are disposed within the tray 376. The container assembly 392 icludes a carrier 396 which secures together a regular array of cans 386. The container assembly 394 includes a carrier 398 which secures together a regular array of cans 386.

A unitary single sheet cover shroud 400 overlies the container assemblies 382, 384, 392 and 394 and is secured to opposed edges of the trays 374 and 376. The cover shroud 400 includes a first handle means 402 and a second handle means 404. The cover shroud 400 also includes a first severable means 406, which extends between the aforementioned opposed tray edges, a second severable means 408 and a third severable means 410.

As best illustrated in FIG. 17*b*, the first severable means 406 of the cover shroud 400 includes a centrally located tear tab 412 bounded by a pair of score lines 414 and 416. The second severable means 408 similarly include a centrally located tear tab 418 bounded by a pair of score lines 420 and 422. The third severable means 410 also includes a centrally located tear tab 424 bounded by a pair of score lines 426 and 428. A pair of fold lines 430 and 432 allow the marginal portions of the cover shroud 400 to bend to engage the tray rim portions 378 and 380.

FIG. 17*c* illustrates the severance of the package 372 into identical subassemblies A and B by tearing the tear tab 412 of the first severable means 406 along the score lines 414 and 416. As illustrated in the figures, the first severable means 406 extends completely around the center of the package 372 such that upon its severance from the package 372, two twelve can subassemblies are created, such subassemblies being labeled subassembly A and subassembly B. Each subassembly may be further accessed. Each subassembly A may be further accessed by tearing severable means 408 by engaging the tear tab 418 to sever the tear tab 418 from the score lines 420 and 422 as shown in FIG. 17*c*. Similarly, access to the container assemblies contained within subassembly B may be achieved by pulling the tear tab 424 such that it cleaves from the score lines 426 and 428, providing access to the interior of subassembly B.

As best shown in FIG. 17*a*, a product identifying label 434, (shown in phantom) usually a laser scannable uniform product code label, is secured to the center portion of the bottom of the package 372, such that it overlies the junction of subassemblies A and B. The label 434 identifies the product for marketing purpose as a 24 can package by an appropriate computer code and is subsequently destroyed when the package 372 is opened into subassemblies A and B. A pair of uniform product identifying labels 433 and 435 are disposed on the tray rims 378 and 380 of subassemblies A and B, respectively. When the 24 pack is opened by a marketer to sell the 12 pack units, subassemblies A and B, separately the labels 433 and 435 serve to identify each as a 12 can package with the appropriate computer coded price information. As shown in FIGS. 17*a–b*, each subassembly has a pair of major surfaces, namely the major top surface of the cover shroud 400 and the major bottom surface of the tray 376. Each subassembly has two open faced minor surfaces wherein through cans are visable for inspection. Each subassembly also has a pair of closed minor surfaces, one of which encloses a handle like either handle 404 or 402, with the opposing minor surface which does not enclose a handle means. The latter minor surfaces provide for attachment of the cover shroud 400 to the upstanding tray rims 378 and 380. One open minor surface from each subassembly provides an edge for the attachment of the severable means 406. This embodiment of the invention provides for edge to edge attachment of the subassemblies. In the preferred embodiment of this edge-to-edge type attachment, two subassemblies, of 12 cans each, are secured together. However, any suitable number of subassemblies may be joined along their respective open faces by severable means to form the package.

Also, while in the embodiment disclosed in FIGS. 17*a–b* each subassembly includes one handle means 402 or 404, if desired, a further handle means comparable to the handle means 204, as illustrated in FIGS. 11*a–c* may be included.

Figure 18A:
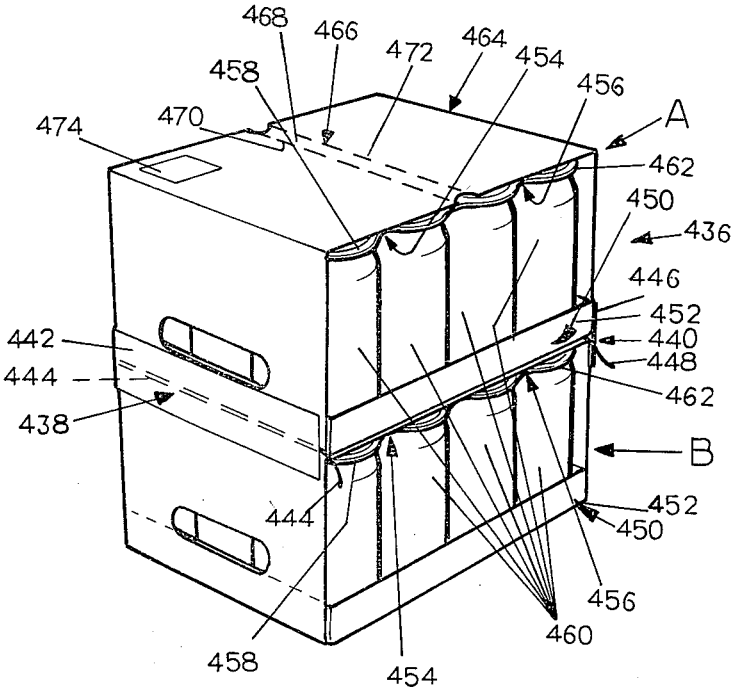
FIG. 18*a* is a perspective view of an alternative embodiment of an assembled package according to the present invention.
Figure 18B:
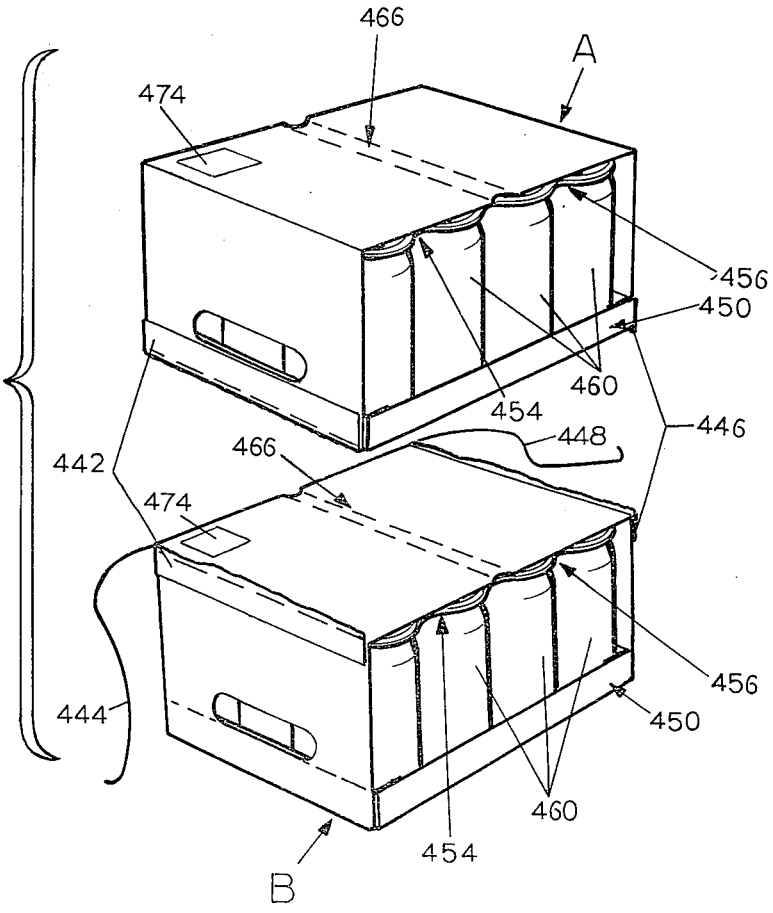
FIG. 18*b* is a perspective view of a severed package derived from the package illustrated in FIG. 18*a;*

An alternative embodiment of a package according to the present invention is illustrated at FIGS. 18*a–b*. FIG. 18*a* illustrates a package 436 according to the present invention including package subassembly A and package subassembly B. Subassemblies A and B are identical as disclosed hereinafter. The subassemblies, A and B, are secured together by a first severable means 438 and a second severable means 440. The first severable means 438 is typically a tear tape 442 including a centrally located tear string 444. Similarly, the second severable means 440 includes a tear tape 446 which includes a centrally located tear string 448.

Subassembly A includes a tray 450 including an upstanding tray rim 452. Contained within the tray 450 are a pair of container assemblies 454 and 456. The container assembly 454 includes a carrier 458 which holds a plurality of cans 460 in a regular geometric array, typically a six-pack. Similarly, container assembly 456 includes carrier 462 which holds a plurality of cans, again typically in a six-pack fashion to form the container assembly 456. The container assemblies 454 and 456 within the tray 450 are overlaid by a cover shroud 464 which is secured to opposed ends of the tray 450 as illustrated hereinbefore at FIG. 11*a*. The cover shroud 464 further includes a severable means 466 comprising a centrally located tear tab 468 bounded by a pair of score lines 470 and 472, respectively. The cover shroud 464 further includes a product identifying label 474, typically a computer scannable uniform product code type label.

Subassembly B includes identical portions to subassembly A as indicated by like reference numerals on the respective subassemblies A and B. FIG. 18*b* illustrates the severability feature of the subassemblies A and B by pulling the tear strings 444 and 448 to sever the tear tapes 442 and 446. Such severance provides two independently storable or usable subassemblies A and B each containing, in the preferred embodiment, twelve cans of product arranged in two convenient six-pack groups. In the embodiment of the invention disclosed in FIGS. 18*a–b* the cover shroud 464 of subassembly A is secured, via the pair of severable means 438 and 440, to the cover shroud 464 of subassembly B resulting in a stacked arrangement. In the preferred embodiment of the invention, two subassemblies, containing 12 cans each, are secured together by severable means. However, any suitable number of subassemblies can be so attached. The package subassemblies may also each include, if desired, a pair of side flaps, analogous to portions 252 and 254 of FIGS. 12*a–b*, for the formation of a total encasement package. Also each subassembly may include a return portion analogous to the return portion 366 illustrated at FIGS. 16*a–c*.

Figure 19A:
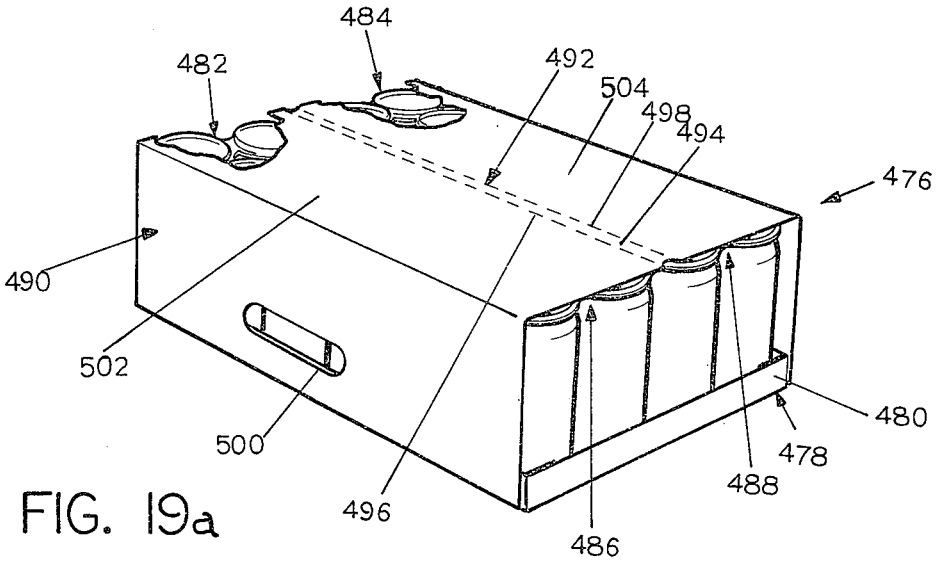
FIG. 19*a* is a perspective view of an alternative embodiment of the package of the present invention.
Figure 19B:
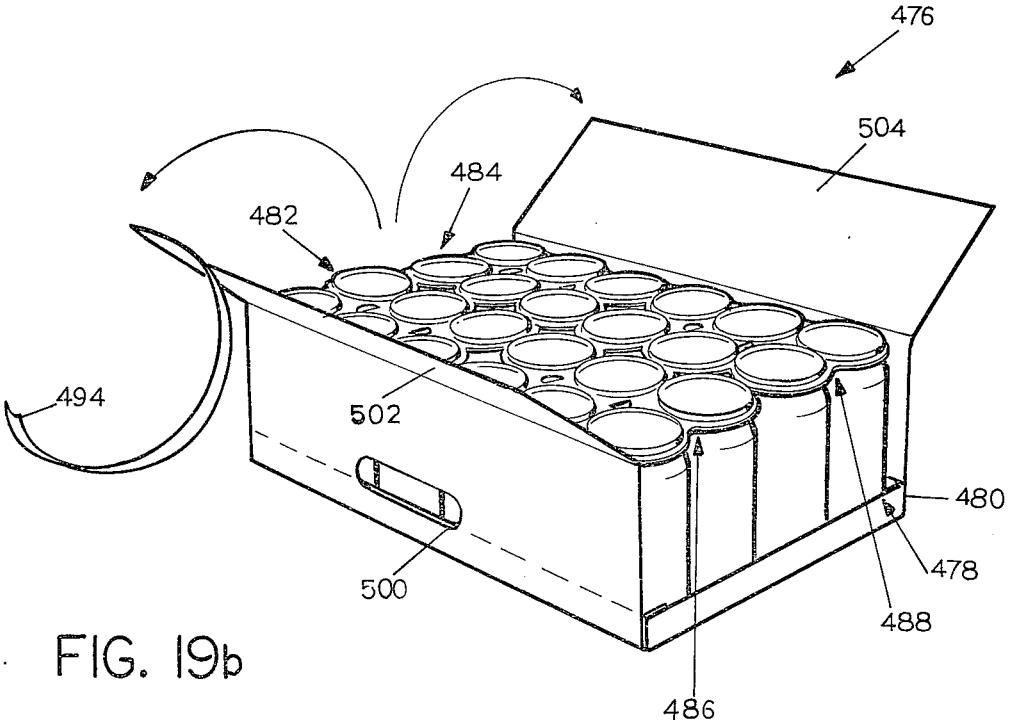
FIG. 19*b* illustrates an open package according to FIG. 19*a;*

An alternative embodiment of the package according to the present invention is illustrated in FIGS. 19*a–b* wherein a package 476 includes a tray 478 having an upstanding tray rim 480. A plurality of container assemblies, namely container assemblies 482, 484, 486 and 488, (each container assembly identical to the container assemblies disclosed and described above with respect to FIG. 1) are placed within the tray 478. A cover shroud 490 overlays the container assemblies 482, 484, 486 and 488 within the tray 478. Opposed edges of the cover shroud 490 are secured to opposed edges of the tray 478. The cover shroud 490 includes a centrally located separable means 492 including a tear tape 494 which is bounded by a pair of score lines 496 and 498. A handle means 500 is provided on one minor face of the cover shroud 490 for ease of handling. FIG. 19*b* illustrates the disengagement of the severable means 492 to provide access to the enclosed container assemblies 482, 484, 486 and 488. Upon severance of the cover shroud 490, a pair of flaps are formed namely a first flap portion 502 and a second flap portion 504. The flap portions 502 and 504 may be folded inwardly of the tray 478, similar to the invention illustrated in FIGS. 5*a–c*, to assist in empty can retention for returning such cans to the place of purchase, where the law so provides.

Figure 20A:
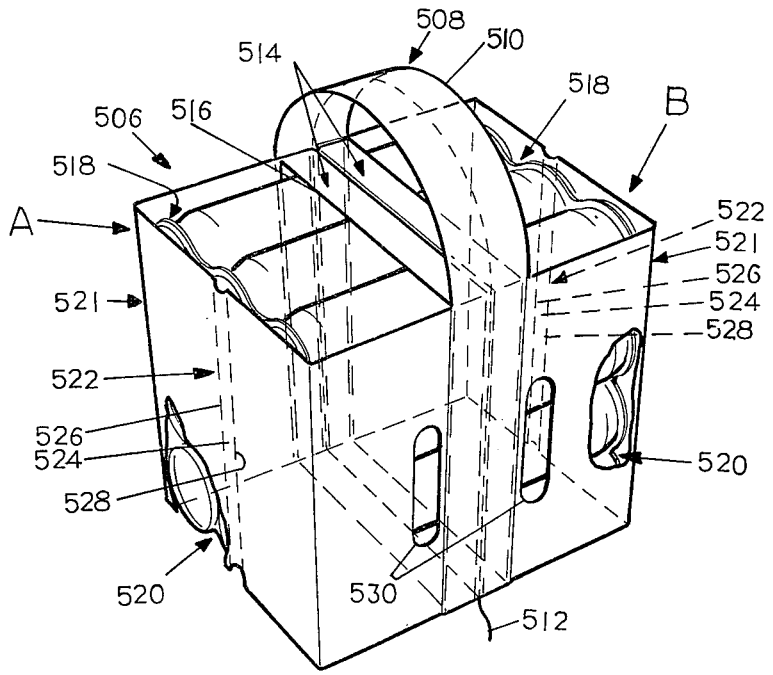
FIG. 20*a* illustrates a perspective view of an alternative embodiment of the package according to the present invention.
Figure 20B:
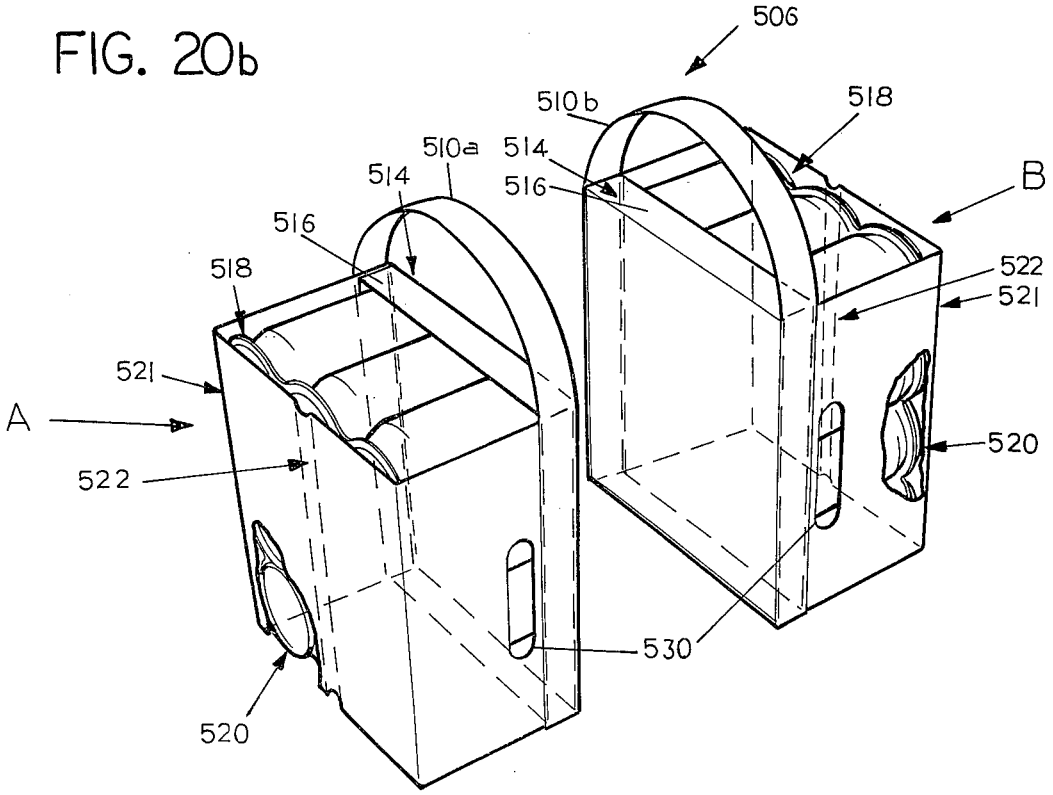
FIG. 20*b* illustrates a perspective view of a severed arrangement of the package illustrated in FIG. 20*a.*

Still a further alternatative embodiment of the present invention is illustrated in FIGS. 20*a–b*. A package 506 is illustrated which includes a handle means 508. The handle means 508 comprises a handle band or strap 510 including a centrally located tear string 512. The package 506 includes a first subassembly A and a second subassembly B. Subassemblies A and B are identical as described hereinafter. Like portions of subassemblies A and B are referenced with like reference numerals. Exemplary of both subassemblies is subassembly A which includes a tray portion 514 having an upstanding tray rim 516. A pair of container assemblies 518 and 520 are fitted within the tray 514 as illustrated. The container assemblies 518 and 520 are identical to the container assemblies illustrated and described in FIG. 1. A cover shroud 521 overlies the container assemblies 518 and 520 and is secured to opposed edges of the upstanding tray rim 516. Severable means 522 secures the subassemblies A and B together on at least two faces of the subassemblies. The severable means 522 includes a centrally located tear tab 524 bounded by a pair of score lines 526 and 528. The subassembly A also includes a handle portion 530 suitable for grasping the package 506. FIG. 20*b* illustrates the relationship of the subassemblies A and B after severance of the unitary package 506 into a pair of discrete subassemblies A and B by tearing the tear string 512 to sever the handle band 510 into two portions, namely, 510*a* and 510*b*. As illustrated, each identical discrete subassembly contains two container assemblies each of which restrains six cans for containing product in a regular geometric array, referred to as a six-pack, in the preferred embodiment.

In the embodiment of the invention disclosed in FIGS. 20*a–b*, the subassemblies are secured such that the trays 514 are abutted and secured together by the severable means 508.

While I have specifically disclosed and described container assemblies wherein the containers themselves are cans, typically made of metal, the invention is equally operative with glass bottles which are held together by thermoplastic carrier means at their neck finish portions or at any other part of the bottle. Similarly, the containers can be composite paper-metal foil containers for holding snack food items.

In accordance with the provisions of the patent statutes, I have explained the principal and mode of operation of the preferred embodiment and alternative embodiments of my invention and I have illustrated and described what I now consider to represent the best mode practicing of my invention; however, it must be understood within the sphere and scope of the appended claims, the invention may be practiced otherwise than is specifically illustrated and described.

What is claimed is:

1. A package for holding cans comprising:

a corrugated paper tray having a generally flat rectangular center portion and an upstanding perimeter portion extending around the entire periphery of said center portion, a plurality of discrete can assemblies within said tray and held therein partially by said upstanding perimeter portion, each said can assembly including a plurality of individual cans in a regular geometric array and a unitary thermoplastic carrier means having a geometric array matching the geometric array of the cans and interconnecting said cans, a single sheet paperboard unitary cover shroud having a thickness less than the thickness of the tray and having a center rectangular portion covering the tops of said container assemblies and at least a pair of rectangular side portions connected to opposed edges of said center portion along parallel fold lines and depending from the center portion and secured to the outside of opposed portions of said upstanding perimeter portion of said tray, and handle means for carrying said package.

2. The package set forth in claim 1 including an integral severable portion in the center portion of the shroud comprising a pair of score lines extending parallel to the fold line connecting the side portions to the center portion and defining a tear strip.

3. The package set forth in claim 2 wherein the dimensions of the central portion of said shroud are such that when the shroud is severed along said score lines and the can assemblies are removed, the severed portions can be folded inwardly along the side portions providing a spring biasing effect so that when the cans have been emptied they may be returned to the tray and the spring biasing will hold the empty cans in the tray.

4. The package set forth in claim 1 wherein said handle means comprises an integral part of said shroud including a first handle portion connected by a fold line to the center portion and a second handle portion connected to the first handle portion by a fold line and folded adjacent the first handle portion, said first and second handle portions having aligned hand receiving openings.

5. The package set forth in claim 4 wherein said second handle portion lies in the plane of and forms part of a side portion.

6. The package set forth in claim 4 wherein said second handle portion is connected to the side portion by a fold line.

7. The package set forth in claim 1 wherein said handle means comprises an integral portion of a side portion of said shroud and is connected to said side portion by a score line and includes an aperture such that the handle portion can be readily severed from the side portion by placing the hand through the aperture and pulling outwardly to cause separation along the score line.

8. The package set forth in claim 7 wherein said handle means includes a second handle portion forming a part of the center portion of the tray and connected thereto by a score line and having an aperture therein such that said second handle portion can be readily severed from the tray by placing the hand through the aperture in the second handle portion and pulling outwardly to cause the second handle portion to be severed along the score line so that it can be folded and brought into position where the aperture of the first handle portion and the aperture of the second handle portion are generally aligned for insertion of a hand and for carrying the package.

9. The package set forth in claim 1 wherein said handle means comprises an aperture in a side portion of the shroud and an aperture in the center portion of the tray adjacent the side portion containing the aperture for receiving portions of the hand.

10. The package set forth in claim 1 wherein said handle means comprises a strip of thin material secured at one end to the center portion of the tray and at the other end to the center portion of the shroud.

11. The package set forth in claim 1 wherein said handle means comprises spaced apertures in a side portion of the shroud for receiving portions of the hand.

12. The package set forth in claim 1 wherein said shroud includes a return portion connected to a side portion along a fold line and extending along the side portion, said return portion having an aperture therein aligned with one of the apertures in the side portion to reinforce the handle means.

13. The package set forth in claim 1 including a second substantially identical package for holding cans comprising a second corrugated paper tray having a generally flat rectangular center portion and an upstanding perimeter portion extending around the entire periphery of said center portion, a second group of a plurality of discrete can assemblies within said second tray and held therein partially by said upstanding perimeter portion, each said can assembly including a plurality of individual cans in a regular geometric array and a unitary thermoplastic carrier means having a geometric array matching the geometric array of the cans and interconnecting said cans, a second single sheet unitary cover shroud made of a thinner material than the second tray having a center rectangular portion covering said container assemblies and at least a pair of rectangular side portions connected to said center portion along a fold line and depending from the center portion and secured to opposed portions of said upstanding perimeter portion of said second tray, handle means for carrying said second package, and severable means for joining said first package and said second package.

14. The package set forth in claim 13 wherein said first and second package are placed adjacent one another with the center portion of the first shroud contacting the center portion of the second shroud.

15. The package set forth in claim 14 wherein said handle means comprises an integral part on each said shroud including a first handle portion connected by a fold line to the center portion of each shroud and a second handle portion connected to the first portion by a fold and filled adjacent the first handle portion and lying in the plane of and forming part of a side portion, said first and second handle portions having aligned hand receiving openings, said handle means of said first package being adjacent said handle means of said second package so that the aligned hand receiving openings of said first and second packages are aligned.

16. The package set forth in claim 13 wherein said second package is stacked on said first package with the second tray engaging the center portion of the shroud of the first package, said severable means joining said packages comprising tear tapes with a tear string joining the tray of the second package and the side portions of the shroud of the first package.

17. The package set forth in claim 13 wherein said center portion of the tray of said first package is positioned with the central portion of the tray of said second package with the side portions of said shroud aligned, said severable means joining said packages comprising a tear strip including a tear string joining said trays along the peripheral portions joined to the side portions of said shroud and including a loop portion defining said handle means.

18. A package for holding cans comprising a pair of substantially identical corrugated paper trays in side-by-side relation, each said tray having a generally flat rectangular center portion and an upstanding perimeter portion extending around the entire periphery of said center portion, a plurality of discrete can assemblies within each said tray and held therein partially by said upstanding perimeter portion, each said can assembly including a plurality of individual cans in a regular geometric array and a unitary thermoplastic carrier means having a geometric array matching the geometric array of the cans and interconnecting said cans, a single paperboard sheet unitary cover shroud having a thickness less than the thickness of the trays and having a center rectangular portion covering the tops of said container assemblies of both said trays and at least a pair of rectangular side portions connected to opposed edges of said center portion along parallel fold lines and depending from the center portion and secured to the outside of opposed portions of said upstanding perimeter portions of said side-by-side trays, and said shroud having a band of score lines extending along the center portion and the side portions at the juncture of the side-by-side trays and defining a tear strip such that when the shroud is severed by pulling on the tear strip, two sub-assemblies are provided, each comprising a tray, a plurality of container assemblies and a shroud, handle means individual to each said sub-assemblies.

* * * * *